US005429569A

United States Patent [19]

Gunnari et al.

[11] Patent Number: 5,429,569

[45] Date of Patent: Jul. 4, 1995

[54] TRAINING APPARATUS

[76] Inventors: Hans Gunnari; Olaf Evjenth, both of Torggt. 16, 0181 Oslo, Norway

[21] Appl. No.: 204,299

[22] PCT Filed: Aug. 11, 1992

[86] PCT. No.: PCT/NO92/00129

§ 371 Date: Mar. 29, 1994

§ 102(e) Date: Mar. 29, 1994

[87] PCT Pub. No.: WO93/04738

PCT Pub. Date: Mar. 18, 1993

[30] Foreign Application Priority Data

Sep. 9, 1991 [NO] Norway ..... 913533

[51] Int. Cl.[6] ..... A63B 21/00

[52] U.S. Cl. ..... 482/100; 482/103; 482/137

[58] Field of Search ..... 482/94, 97-103, 482/136-138, 114, 129, 112

[56] References Cited

U.S. PATENT DOCUMENTS 4,603,855 8/1986 Sebelle .
4,623,144 11/1986 Rockwell ..... 482/137
4,721,303 1/1988 Fitzpatrick ..... 482/103
4,898,381 2/1990 Gordon ..... 482/137 X

FOREIGN PATENT DOCUMENTS 3602982 8/1986 Germany .
2170413 8/1986 United Kingdom .
1586724 10/1988 U.S.S.R. .

*Primary Examiner*—Richard J. Apley
*Assistant Examiner*—John Mulcahy
*Attorney, Agent, or Firm*—Eckert Seamans Cherin & Mellott

[57] ABSTRACT

A physical fitness training apparatus includes a mainly upright module, a training arm which projects out from the main module and rotates about a horizontal pivot axis, the training arm having grips or manipulation devices for use by the person exercising, a loading arrangement, and, a flexible tie with pulleys for load and motion transfer between the training arm and the load arrangement. The physical fitness training apparatus further includes a main arm which projects out from the main module and may be adjusted at angles about the horizontal pivot axis. The main arm has a first pair of pulleys located near and over/under each other at the outer free end of the main arm. The flexible tie extends from an attachment point on the training arm between the gap between the pulleys of the first pair of pulleys. The main arm has another pair of pulleys located near and over/under each other at the same horizontal pivot axis mentioned above. The flexible tie also extends between the pulleys of the second pair of pulleys. Additionally, the physical fitness training apparatus includes an adjustment mechanism arranged and devised to permit fixing the main arm at various angles.

8 Claims, 2 Drawing Sheets

TRAINING APPARATUS

This invention concerns a physical fitness training apparatus so constructed that it includes a framework which mostly comprises an upright main part, a training arm which projects out from the main part and may be rotated about a horizontal axis and has grips or suitable parts to be used by the person training, a loading arrangement and a flexible tie element with ancillary pulleys for load and motion transfer between the training arm and the loading arrangement.

There is a need for a physical fitness training apparatus which permits the user to perform many different exercises, preferably individually adapted, as according to height, strength and general level of fitness.. Previously this has required the installation of numerous differing training apparatus in an exercise room or similar area, such that the user can have an adequately broad and varied exercise programme. For instance, it thus far has been common to have separate training apparatus respectively for arm exercises involving pulling towards the body and pushing away from the body.

A vital purpose of this invention is to provide a physical fitness training apparatus which permits the execution of several different exercises, and which may be readily rearranged to suit that purpose and with adjustments to suit the individual user's wishes and needs.

According to the invention, these requirements have been fulfilled in an advantageous way in a new apparatus for physical fitness training, the new and distinctive features of which are stated in the patent claims.

With the combinations and adjustments possible according to the invention, physical fitness training with an apparatus may be considerably simplified, as well as be executed in less space than possible with conventional apparatus.

Figure 1:
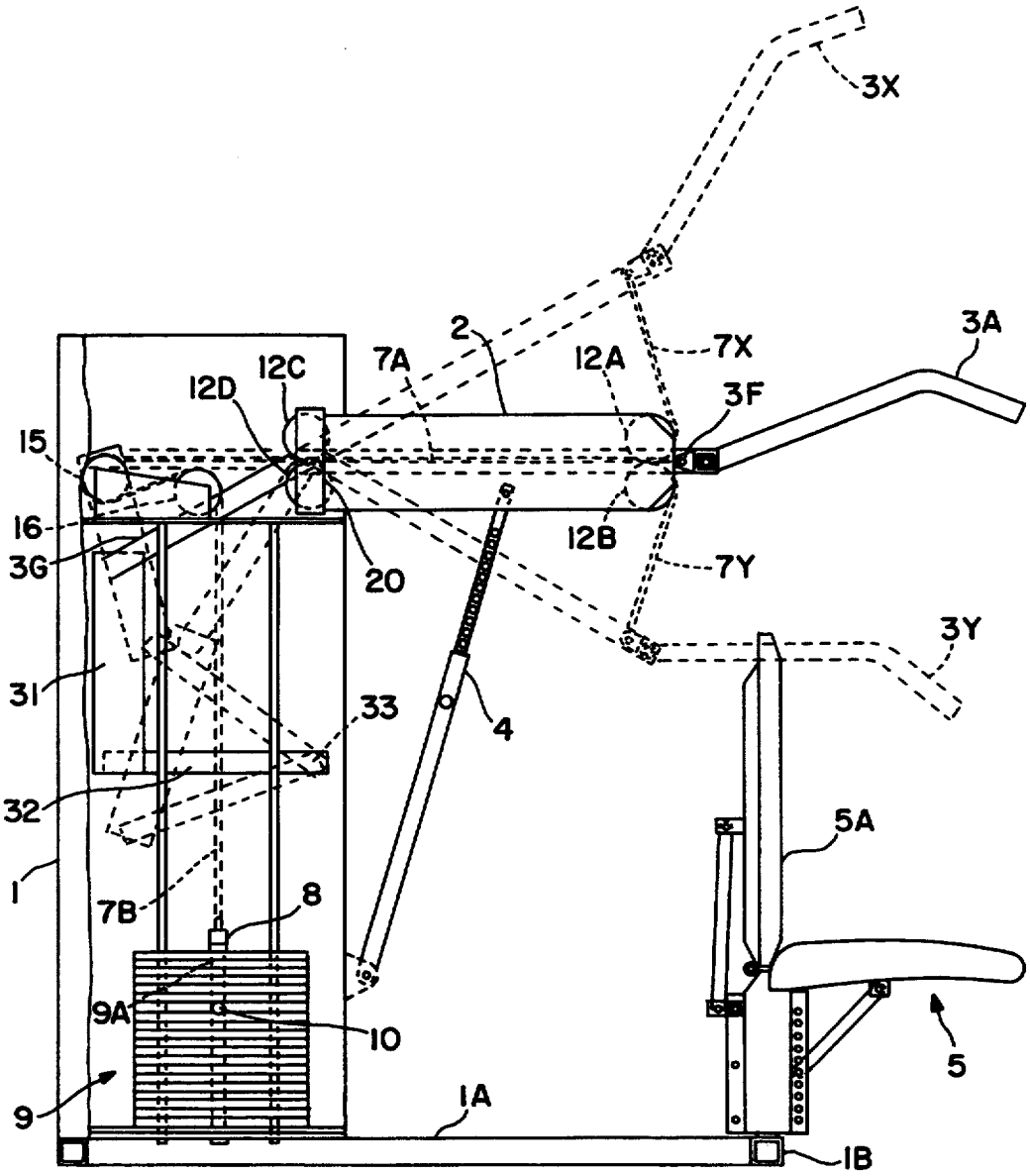
Figure 2:
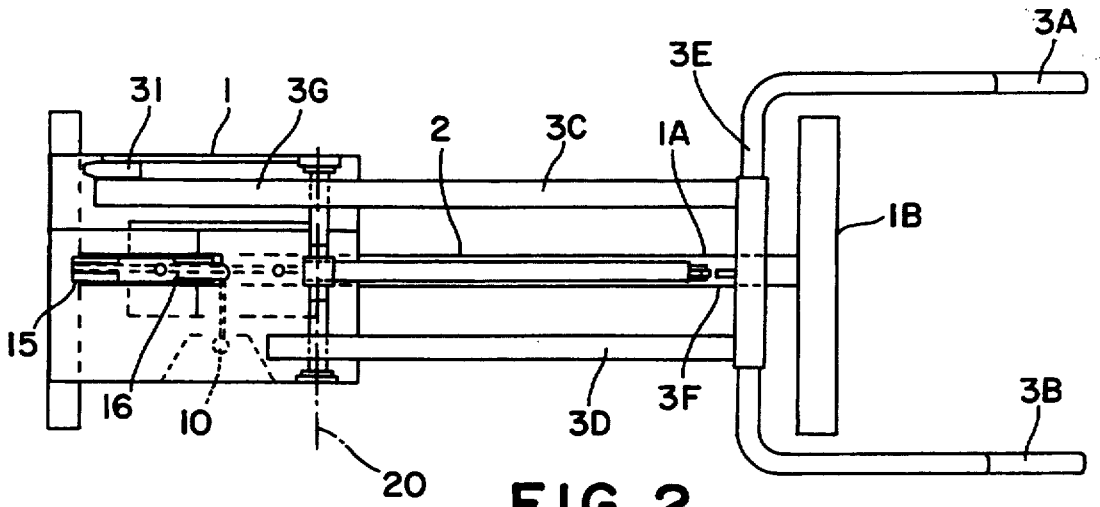
Figure 3:
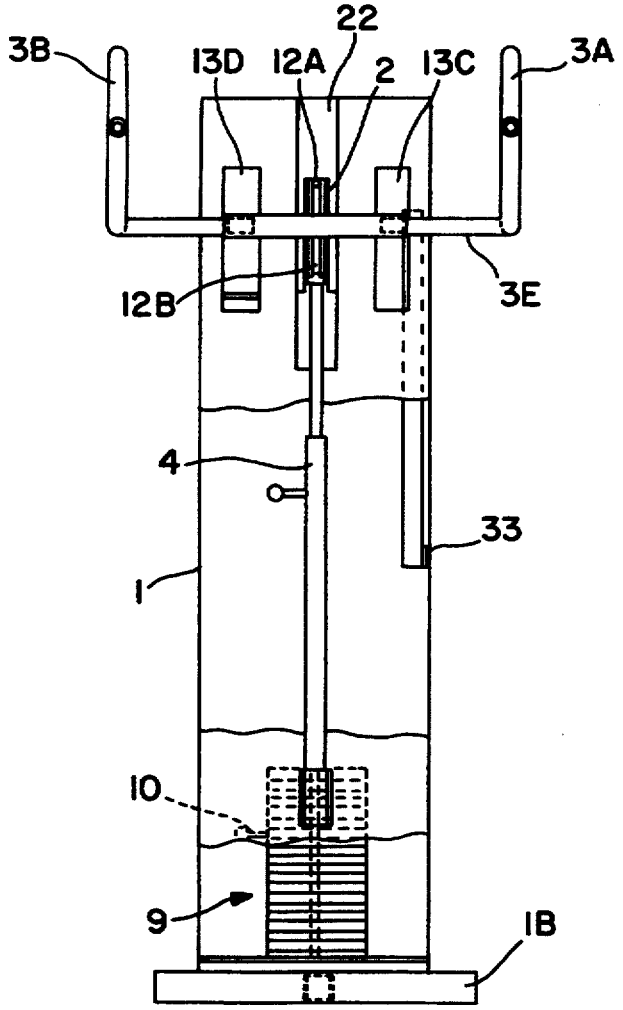

Other advantages and distinctive features of the physical fitness training apparatus according to the invention will be further described as follows with reference to the attached drawings, in which:

FIG. 1 comprises a schematic and partly transparent view of the interior of the apparatus according to the invention in a side view, FIG. 2 is a top view of the apparatus of FIG. 1, and FIG. 3 is a front view of the apparatus.

The physical fitness training apparatus shown here is built up on a longitudinal beam 1A with a transverse beam 1B for the support of seat 5. Seat 5 has a back support which may be folded down to form a bench-like support. The upright main module 1 on the frame contains devices including a loading arrangement in the form of a stack of weights 9 which in a normal way permit selecting loading according to the individual user and the exercise selected. The training arm with grips 3A and 3B is via a flexible tie element, usually a chain, connected to the upper end of weight stack 9. Choice of load, that is the number of weights, is itself recognized in that the free end of the chain 7B is fastened to a pin 8 arranged to be inserted through centrally-located, vertical holes through the weights of the stack 9. Horizontal holes, such as hole 9A in the uppermost weight of the stack, correspond to holes of equivalent mutual spacing diametrically through pin 8, such that transverse pin 10 permits selecting the number of weights corresponding to the suitable load for the exercise in question.

As explicitly shown in FIGS. 1 and 2, the training arm comprises several parts, although it is obvious that other and perhaps simpler designs of a training arm could conceivably be used in a physical fitness training apparatus based on this invention. Two parallel arm parts 3C and 3D together can rotate about horizontal axis 20, in that arm part 3C has extension 3G inside main module 1. The axis of rotation 20 is in this case also shown inside the section of main module 1. As shown in FIG. 3, slots 13C and 13D in the front surface of main module 1 permit the training arm to move up and down in relation to a selected starting position.

At the outer ends of arm parts 3C and 3D, a transverse arm 3E is affixed, which after bends at approximately right angles at each end, continues further outwards in handles 3A and 3B, which in general may be used as grips or manipulating means by the person exercising. In most instances parts 3A and 3B act as grips, but with suitable modification in form may also serve to be manipulated by the feet or other parts of the users body, should exercise so require. In this connection, it is accordingly clear that a transverse bar can also be mounted between the outer ends of handles 3A and 3B.

In FIG. 1 the training arm is shown in dashed outline in two extreme positions (3X, respectively 3Y) displaced from a by-in-large horizontal starting position.

In addition to the training arm discussed immediately above, the apparatus has a main arm 2 which like the training arm swings about the horizontal axis 20 mentioned above. However the main arm 2 is intended to be fixed at various angles by using an adjustment device in the form of a telescopic strut 4, wherein the angle adjustment is set by a transverse pin inserted through a hole selected from those in a row in the inner part of the telescopic strut. A slot 22 in the front face of the main module, corresponding to slots 13C and 13D shown in FIG. 3 permits various angular positions of main arm 2. With an upright main module 1, and a normal position of the main arm 2 horizontally out from the main module, as shown in FIG. 1, the main arm may advantageously be adjusted in angle equally as much above as below the horizontal.

The angular position of the main arm 2 as fixed via the adjustment strut 4, determines the initial position of the training arm 3A–g, as for example as shown in FIG. 1 (arm shown in solid lines out to handle 3A). From such a starting position exercises may be done upward and/or downward. In both of these directions, the user experiences load in that a greater or lesser number of the weights in stack 9 are raised, as explained in the following.

The main arm 2 carries two pulleys 12A, 12B at its outer, free end, and another pair of pulleys, 12C, 12D at its inner end and near the horizontal axis of rotation 20. From attachment point 3F on transverse arm 3E, a chain 7A runs in between the two pairs of pulleys and further in main module 1, further to pulley 15, and out from the lower side of it over a centrally-located pulley 16, whereafter pulley pair 7B guide to weight stack 9 previously described.

Regardless of the angular position of the main arm 2, that is the initial position of the training arm 3A, the chain 7A–B will raise the attached weights with movement of the training arm away from its initial position. In moving the training arm 3A upward from the initial position shown in FIG. 1 toward the uppermost position 3X, chain section 7X will be pulled out between pulleys 12A and 12B, while a corresponding chain section 7Y will be pulled down with movement of the training arm downward to the lowermost position 3Y.

The arrangement described comprises geometric conditions which permit fixing the main arm 2 at various angles with simultaneous placement of the training arm in corresponding initial positions, without difficulty of tightening or loosening chain 7A–B. In this way it is important that the outermost pulley 15 lie such that a tangent to its uppermost edge be approximately horizontally aligned with the gap between pulleys 12C–D, as shown in FIG. 1.

Another important feature is the location of the attachment point 3F for the chain section 7A on the training arm. As especially illustrated in FIGS. 1 and 2, the attachment point 3F is located on transverse arm 3E at a very small spacing out from the free end of main arm 2, that is outside the outer periphery of pulleys 12A–B, such that attachment point 3F just clears these pulleys as the training arm is moved past them. When the chain length from attachment point 3F to the gap between pulleys 12A and 12B is the least possible, the initial position of the training arm locates best in relation to main arm 2. Functionally, in performing exercises, this is important, in part because there is negligible or no difference in the user's perception of the exertion required to raise or to lower the training arm with respect to its initial position.

Closely associated with the principles of operation described above, it is advantageous that a counterweight is located in main module 1. More specifically, the actual counterweight 31, rotatable about the end of arm extension 3G, and connected via rotatable link 32 to fixed point 33' in the main module. The counterbalancing system's positions corresponding to the positions 3X and 3Y of training arm as shown in FIG. 1., are shown in dashed outline. With a suitable sizing of the counterweight, the training arm is counterbalanced in all starting positions such that it is aligned with main arm 2 and gives an approximately straight chain run from pulleys 12A–B to attachment point 3F without unduly bearing against either pulley race.

The apparatus described permits performing many different exercises of physical fitness training programmes from standing, sitting or possibly prone or supine positions. Particularly from a supine position, the training arm may be manipulated with the feet.

It is clear that the principle concept according to the invention may form the basis for practical designs which depart to a greater or lesser degree from the illustrative example discussed above in connection with the attached drawings. The chain may, for instance, be more like a cord, as it is important that it not stretch. The adjust mechanism for the angular positions of the main arm may, as an alternative to that shown, comprise an arc with holes or similar mechanisms in the main module, that work together with suitable devices in the main arm, with pegs or other locking mechanisms. Furthermore, the loading arrangement may be devised in ways differing from that shown, such as being based on hydraulic or pneumatic cylinders, electric solenoids, etc. The vertical and horizontal orientations and directions of the above description are to a degree determined by the use of weights for loading, so should other load arrangements be used, deviations in design from the described vertical, respectively horizontal, arrangements may arise. However, in most cases it is desirable that the movements of the training arm in exercise be by in large upward or downward.

We claim:

1. A physical fitness training apparatus comprising:

a generally upright main module, a training arm extending out from a pivotal connection on the main module defining a horizontal pivot axis, wherein said training arm has grip or manipulation devices for use by the person training and has an attachment point, a loading arrangement, a flexible, tie the element associated with at least first and second pairs of pulleys for load and movement transfer between the training arm and the loading arrangement, a main arm extending out from a pivotal connection on the main module to an outer end, wherein the main arm is angularly adjustable about said horizontal pivot axis, the first pair of pulleys being located near the outer end of the main arm and positioned relative to each other such that one is over the other, wherein the flexible tie extends from a connection to the attachment point on the training arm and between the pulleys of the first pair of pulleys, the second pair of pulleys being located near said horizontal pivot axis and positioned relative to each other such that one is over the other, wherein the flexible tie additionally extends between the pulleys of the second pair of pulleys, and adjustable means for adjustably fixing the main arm at various angles about said horizontal pivot axis, whereby the training arm and the main arm pivot around the same horizontal pivot axis for performing different exercises.

2. A physical fitness training apparatus according to claim 1, wherein:

the adjustable means comprises a telescoping strut extending between a point on the main module and a point on the main arm.

3. A physical fitness training apparatus according to claim 1, wherein:

the main arm is pivotally mounted such that the main arm can be moved approximately equally as much upward as downward from the horizontal.

4. A physical fitness training apparatus according to claim 1, further comprising:

a pulley, rotatably mounted with respect to the main module, having a periphery and an upper point on said periphery which is generally horizontally coplanar with the gap between the pulleys of the second pair of pulleys.

5. A physical fitness training apparatus according to claim 1, further comprising:

a counterbalancing system, mounted to the main module, for the training arm.

6. A physical fitness training apparatus according to claim 1, wherein:

said attachment point in the training arm is at a slightly greater distance from the horizontal pivot axis than the first pair of pulleys, such that the attachment point is spaced from the pulleys of the first pair of pulleys when the training arm is moved past the main arm.

7. A physical fitness training apparatus according to claim 1, wherein:

the training arm comprises two parallel segments positioned such that the main arm extends between the two parallel segments of the training arm.

8. A physical fitness training apparatus according to claim 7, wherein:

the two parallel segments have outer ends carrying a transverse arm, said attachment point being on the transverse arm.

* * * * *